United States Patent [19]

Hilzinger et al.

[11] Patent Number: 4,812,181

[45] Date of Patent: Mar. 14, 1989

[54] METHOD OF ACHIEVING A FLAT MAGNETIZATION LOOP IN AMORPHOUS CORES BY HEAT TREATMENT

[75] Inventors: Hans-Rainer Hilzinger, Langenselbold; Giselher Herzer, Hanau, both of Fed. Rep. of Germany

[73] Assignee: Vacuumschmelze GmbH, Fed. Rep. of Germany

[21] Appl. No.: 26,012

[22] Filed: Mar. 16, 1987

[30] Foreign Application Priority Data

Apr. 5, 1986 [DE] Fed. Rep. of Germany ..... 3610527

[51] Int. Cl.[4] ..... H01F 1/00

[52] U.S. Cl. ..... 148/121; 148/305

[58] Field of Search ..... 148/120, 121, 122

[56] References Cited

U.S. PATENT DOCUMENTS 4,226,619 10/1980 Hatta et al. ..... 148/121
4,311,539 1/1982 Uedaira et al. ..... 148/121

FOREIGN PATENT DOCUMENTS 211422 11/1982 German Democratic Rep. .
59-74267 4/1984 Japan ..... 148/122
2117979 10/1983 United Kingdom .

OTHER PUBLICATIONS

"Magnetic Properties and Relaxation Processes of Magnetic Anisotropy in Amorphous Magnetic Ribbons Due to Heat Treatment," Imamura et al, IEEE Trans. on Mag., vol. MAG-17 No. 6 (Nov. 1981).

"Development of Amorphous Fe-B Based Alloys For Chock And Inductor Applications," Major et al, IEEE Trans. on Magnetics, vol. Mag-20, No. 5, Sep. 1984, pp. 1415-1416.

"Origin of the Perpendicular Anisotropy in Amorphous $Fe_{82}B_{12}Si_6$ Ribbons," Ok et al, Physical Review, vol. 23, No. 5, pp. 2257-2261, Mar. 1981.

*Primary Examiner*—John P. Sheehan

[57] ABSTRACT

A method for achieving a flat magnetization loop in cores, such as for use in inductive components, which are wound of amorphous ribbon includes the steps of subjecting the wound core to long-term heat treatment of more than 10 hours, and selecting the temperature during the heat treatment so low that less than half of the ribbon cross-section exhibits crystalline precipitations which occur during the heat treatment.

3 Claims, 4 Drawing Sheets

METHOD OF ACHIEVING A FLAT MAGNETIZATION LOOP IN AMORPHOUS CORES BY HEAT TREATMENT

BACKGROUND OF THE INVENTION

1. Field of the Invention

The present invention is directed to a method for achieving a flat magnetization loop in amorphous cores by a heat treatment, and in particular to such a method for treatment of cores for use in inductive components wound of amorphous ribbon.

2. Description of the Prior Art

As discussed in the periodical IEEE Transactions on Magnetics, September 1984, pages 1415–1456, different magnetization curves can be obtained in an iron rich amorphous alloy by means of a 5 hour heat treatment at a termperature between 425° and 595° C. Dependent on the selection of the temperature in the heat treatment, permeabilities of $\mu_r=700$ up to a pre-magnetizing field strength of $H_c=15$ A/cm, or a permeability of $\mu_r=200$ up to a pre-magnetization field strength of $H_c=100$ A/cm can be achieved.

An article by Ok and Morrish in Physical Review Vol. 23, (1981), pages 2257–2261 discloses a heat treatment for alloys with 40% iron and 40% nickel, wherein the alloy is exposed to a temperature between 375° and 400° C. for 10 hours. Iron rich alloys having 65% or 82% iron are respectively heat-treated for one hour or 20 minutes. Cystalline precipitations, predominantly at the surface of the ribbon, which cause a volume reduction at the surface, arise due to this heat treatment. As a consequence, compressive strains occur in the inside of the ribbon, resulting in a preferred magnetization direction perpendicular to the longitudinal (longest) direction of the ribbon in the amorphous core due to the positive magnetostriction of the iron rich alloy. This causes the remanence magnetization and the permeability to be reduced be the heat treatment, so that such heat-treated cores are suitable for inductive components using DC pre-magnetization.

SUMMARY OF THE INVENTION

An object of the present invention is to provide a method for setting the properties of amorphous cores such that a low coercive field strength results given the same remanence as in conventional cores, thereby permitting extremely small permeability values to be achieved given a coercive field strength which is feasible.

The above object is achieved in accordance with the principles of the present invention in a heat treatment of more than 10 hours wherein the core is subjected to a temperature during the heat treatment which is selected so low that less than half of the ribbon cross-section exhibits crystalline precipitations.

The method disclosed herein is based on the preception that the crystalline precipitations arising at the surface of iron rich amorphous ribbons due to heat treatment grow slowly into the interior of the ribbon given a limited temperature. An increasing thickness of the crystalline surface layer is thus achieved by chronologically extending the heat treatment without nucleii for crystals forming in the interior of the ribbon.

DESCRIPTION OF THE PREFERRED EMBODIMENTS

Figure 1:
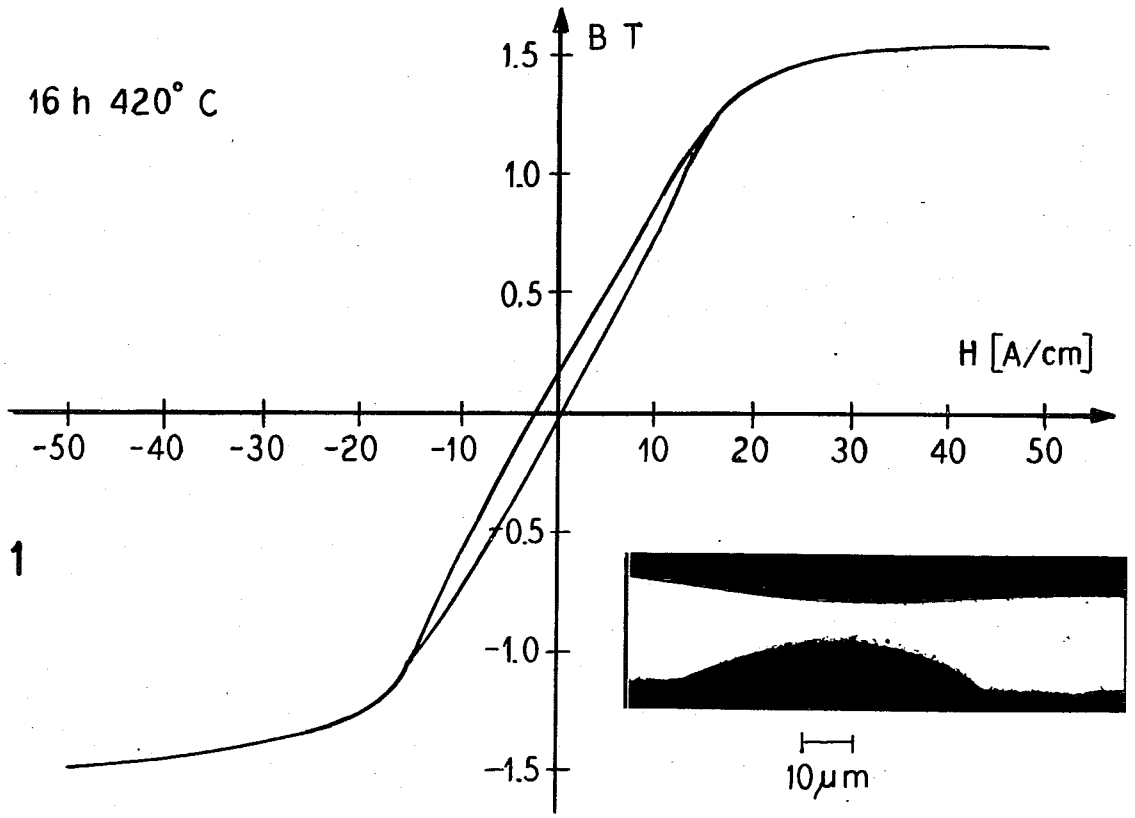
FIG. 1 is a magnetization curve and a polished section for a ribbon treated with the method disclosed herein at a temperature of 420° for 16 hours.

The magnetization curve showing low remanence magnetization, and a polished section taken through a ribbon of amorphous alloy after the ribbon was stored at 420° C. for 16 hours are shown in FIG. 1. The layer of crystalline precipitations can be seen as black in the polished section. It can be seen at the boundary layers between the amorphous core and the surface layers permeated by the crystalline precipitations that the crystals grow from the edges toward the interior of the ribbon. Substantially no nucleii formation occurs in the central interior portion of the ribbon. When the heat treatment is extended, the thicker crystal layers at the surface are obtained on an average.

Figure 2:
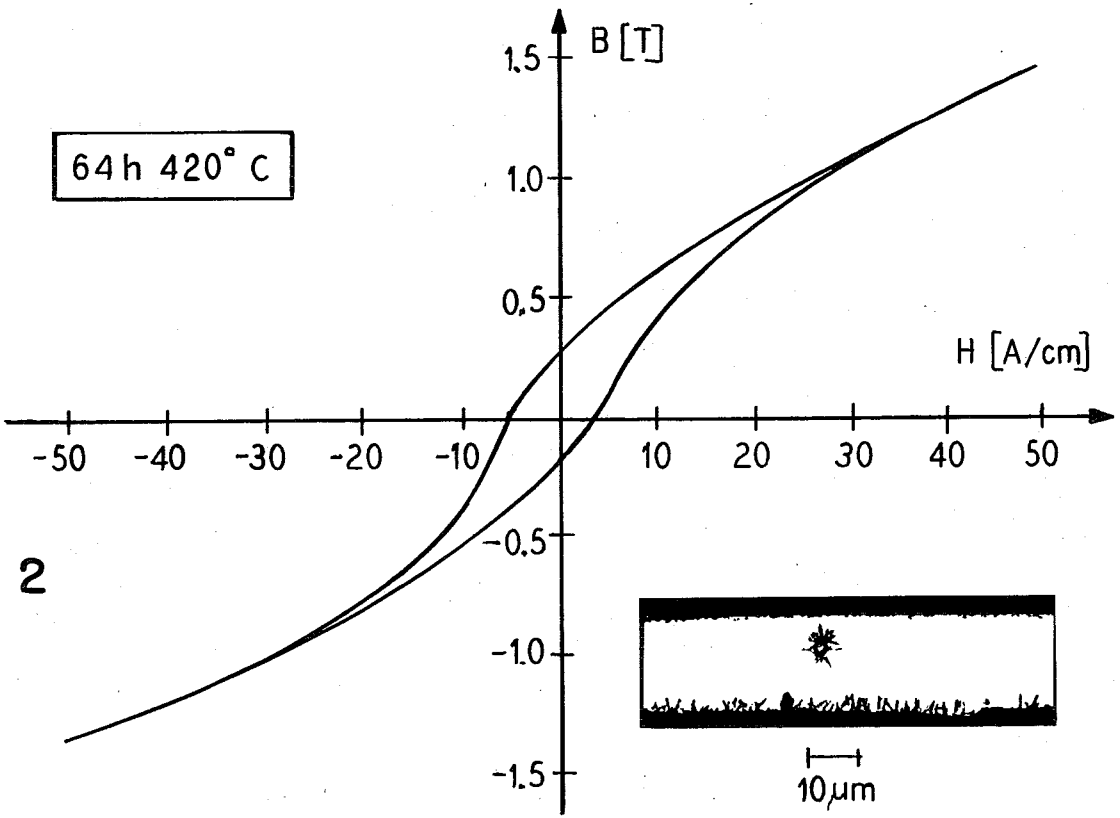
FIG. 2 shows the magnetization curve and a polished section for a ribbon treated in accordance with the method disclosed herein at 420° C. for 64 hours.

Another magnetization curve is shown in FIG. 2 with a polished section of the same alloy as shown in FIG. 1. This alloy, and the alloy in FIG. 1, comprise 78 atomic percent iron 9 atomic percent silicon, and 13 atomic percent boron. A relative permeability $\mu_r=796$ given a coercive field strength of 0.695A/cm was measured at the core comprising the ribbon of FIG. 1, and a relative permeability $\mu_r=246$ given a coercive field strength of 3.49A/cm was measured at the core comprising the ribbon of FIG. 2. Especially low permeabilities can thus be achieved by longer treatment times without having the coercive field strength rise excessively.

Figure 3:
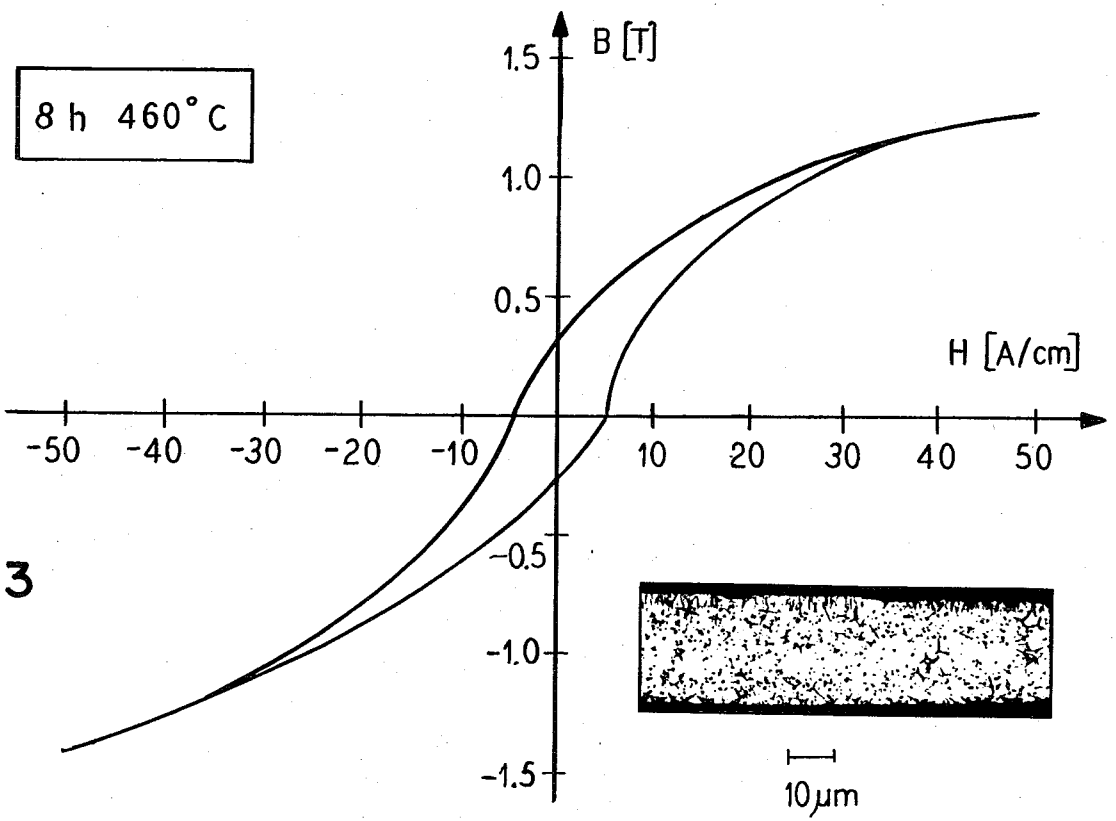
FIG. 3 shows the magnetization curve and a polished section for a ribbon treated at 460° C. for 8 hours.

For comparison, FIG. 3 shows the magnetization curve and a polished section for a core which was heat-treated at 460° C. for 8 hours. Nucleii formation in the interior of the ribbon can clearly be seen in FIG. 3. A low relative permeability $\mu_r=214$ was measured. The coercive field strength of $H_c=5.25$A/cm is already relatively high.

Figure 4:
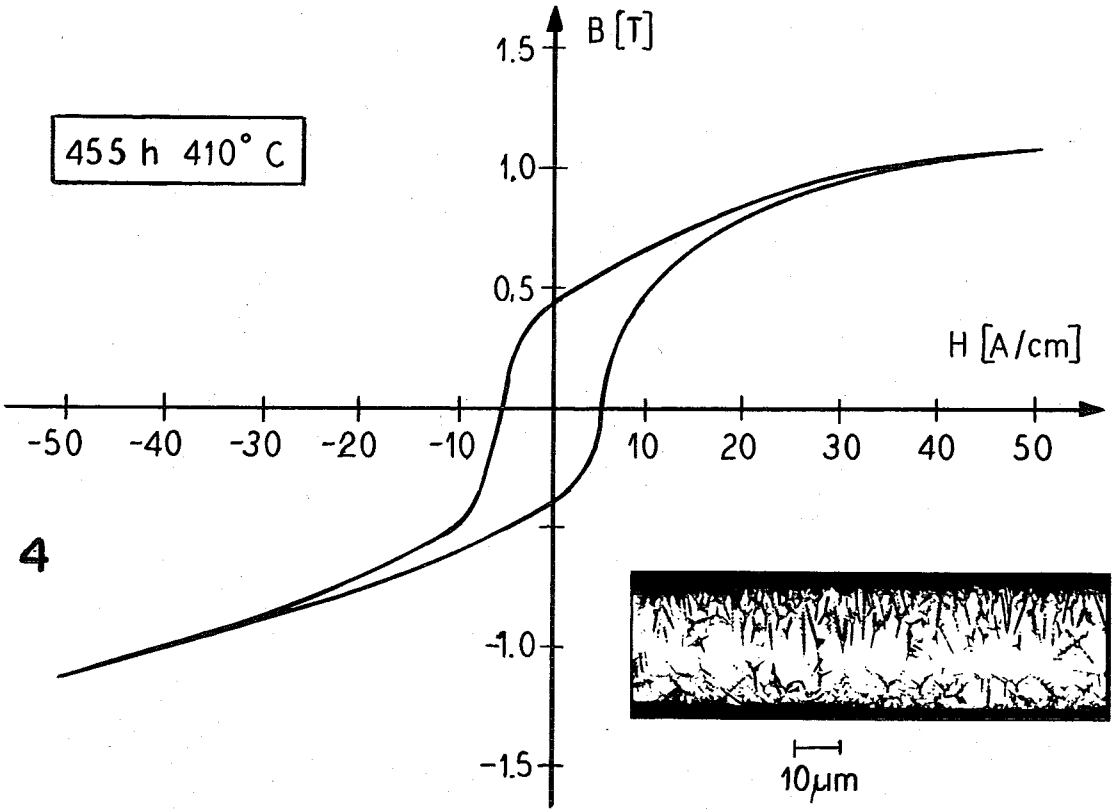
FIG. 4 shows the magnetization curve and a polished section for a ribbon treated at 410° C. for 455 hours.

The magnetization curve and a polished section for an extremely long term heat treatment of 455 hours at 410° C. are shown in FIG. 4. Although little nucleii formation can be seen in the core in FIG. 4, the crystals grow from the sides rather far into the interior of the ribbon. As a result, an especially low relative permeability of $\mu_r=137$ is obtained. The coercive field strength, however, is already relatively high at $H_c=5.8$A/cm due to the rather advanced crystallization in the ribbon interior. A further reduction in temperature would have to be undertaken in accordance with the teachings of the method disclosed herein given such long term treatment.

The above examples demonstrate that a high saturation induction (above 1.2 Tesla) given a variable, relative permeability, and a low coercive field strength with respect to the permeability, can be achieved with an iron rich alloy preferably containing more than 60 atomic percent iron.

Although modifications and changes may be suggested by those skilled in the art it is the intention of the inventors to embody within the patent warranted hereon all changes and modifications as reasonably and properly come within the scope of their contribution to the art.

We claim as our invention:

1. A method for achieving a flat magnetization loop in a core wound of amorphous ribbon adaptable for use in a inductive component, said method comprising the steps of:

subjecting said core to a long-term heat treatment of more than 10 hours at a temperature greater than 410° C. and so far below the crystallization temperature of said amorphous ribbon to produce crystalline precipitation prodominantly at a surface of said ribbon; and selecting the temperature during said heat treatment so low such that less than half of the ribbon cross-section exhibits crystalline precipitations at the conclusion of the treatment.

2. A method as claimed in claim 1, comprising the additional step of selecting an alloy for said amorphous ribbon having greater than 60 atom percent iron thereby achieving a saturation induction above 1.2 Tesla.

3. A method as claimed in claim 1, wherein the step of subjecting said core to heat treatment is further defined by subjecting said core to a long-term heat treatment of more than 30 hours, thereby achieving a relative permeability below 500 and a coercive field strength below 5A/cm.

* * * * *